US010882678B2

(12) United States Patent
Rapparini

(10) Patent No.: US 10,882,678 B2
(45) Date of Patent: Jan. 5, 2021

(54) REINFORCEMENT RING FOR CAPSULES FOR OBTAINING BEVERAGES

(71) Applicant: Gino Rapparini, Bologna (IT)

(72) Inventor: Gino Rapparini, Bologna (IT)

( * ) Notice: Subject to any disclaimer, the term of this patent is extended or adjusted under 35 U.S.C. 154(b) by 0 days.

(21) Appl. No.: 15/315,623

(22) PCT Filed: May 29, 2015

(86) PCT No.: PCT/IB2015/054074
§ 371 (c)(1),
(2) Date: Dec. 1, 2016

(87) PCT Pub. No.: WO2015/186035
PCT Pub. Date: Dec. 10, 2015

(65) Prior Publication Data

US 2017/0210534 A1 Jul. 27, 2017

(30) Foreign Application Priority Data

Jun. 4, 2014 (IT) ..... BO2014A0325

(51) Int. Cl.

| | |
|---|---|
| ***B65D 85/80*** | (2006.01) |
| ***B65D 65/46*** | (2006.01) |
| ***B65D 77/22*** | (2006.01) |
| ***B65D 85/804*** | (2006.01) |

(52) U.S. Cl.
CPC ..... *B65D 77/22* (2013.01); *B65D 65/466* (2013.01); *B65D 85/8043* (2013.01)

(58) Field of Classification Search
CPC .. B65D 85/8043; B65D 77/22; B65D 65/466; B65D 85/804; B65D 85/8046; B65D 41/42; B65D 41/12; B21D 51/48
See application file for complete search history.

(56) References Cited

U.S. PATENT DOCUMENTS 1,830,929 A * 11/1931 Cohen ..... A44C 9/003 63/15
3,305,626 A 2/1967 Mohr et al.
3,746,198 A * 7/1973 Howland ..... A61J 11/00 215/11.1

(Continued)

FOREIGN PATENT DOCUMENTS

EP 0524464 A1 * 1/1993 ..... B65B 29/02
EP 2 383 198 A1 11/2011

OTHER PUBLICATIONS

Human Translation of EP0524464. Published 1993. (Year: 1993).*

(Continued)

*Primary Examiner* — Ericson M Lachica
(74) *Attorney, Agent, or Firm* — Fattibene and Fattibene LLC; Paul A. Fattibene

(57) ABSTRACT

The present invention provides a reinforcement ring (10) for capsules for obtaining beverages, for example espresso coffee, comprising a side wall (1) and a flat surface, preferably having a uniform thickness (2), protruding from the side wall (1), wherein the side wall (1) and the protruding flat surface (2) are made in a single body and wherein the side wall (1) comprises reduced thickness areas (3), so as to reduce the total amount of material used for the production of the ring. A capsule for obtaining beverages comprising such a reinforcement ring (10) is also provided.

23 Claims, 6 Drawing Sheets

(56) References Cited

U.S. PATENT DOCUMENTS 4,830,205 A * 5/1989 Hammond ..... A61J 9/005 215/11.1
5,682,768 A * 11/1997 Nissenbaum ..... A44C 9/003 63/15.1
5,758,787 A * 6/1998 Sheu ..... A61J 9/005 215/11.1
6,170,386 B1 * 1/2001 Paul ..... A47J 36/2433 222/146.5
8,100,276 B2 * 1/2012 Moor ..... A61J 9/005 215/11.1
2004/0225369 A1 * 11/2004 Lakin ..... A61F 2/32 623/22.15
2007/0186584 A1 * 8/2007 Varcin ..... A44C 9/0023 63/15.2
2008/0061023 A1 * 3/2008 Moor ..... A61J 9/005 215/11.3
2008/0173612 A1 * 7/2008 Renz ..... A61J 9/04 215/260
2008/0184738 A1 * 8/2008 Smarsh ..... A44C 9/00 63/15
2009/0004335 A1 * 1/2009 MacMahon ..... A47J 31/0689 426/78
2009/0025977 A1 * 1/2009 Anderson ..... H02G 3/0675 174/653
2009/0078670 A1 * 3/2009 Brandon ..... A61J 7/0472 215/218
2009/0173642 A1 * 7/2009 Blanc ..... B65D 85/8046 206/0.5
2010/0252617 A1 * 10/2010 Dayton ..... B31C 9/00 229/4.5
2011/0142996 A1 6/2011 Kruger ..... 426/80
2011/0212225 A1 * 9/2011 Mariller ..... B65D 85/8043 426/80
2011/0247975 A1 * 10/2011 Rapparini ..... B65D 85/8043 210/321.6
2012/0090475 A1 * 4/2012 Deuber ..... B65B 29/02 99/295
2013/0139700 A1 * 6/2013 Fabozzi ..... B29C 45/0046 99/295
2013/0256255 A1 * 10/2013 Van Volkenburg ..... A61J 9/00 215/11.1
2014/0318380 A1 10/2014 Doglioni Majer ..... 99/295
2015/0034586 A1 * 2/2015 Frishman ..... B65D 17/4011 215/328
2015/0368033 A1 * 12/2015 Krug ..... B65D 85/8043 426/112

OTHER PUBLICATIONS

Report or action dated Jan. 27, 2015 in corresponding Italian Application No. BO2014A000325.
International Preliminary Report on Patentability dated May 6, 2016 for corresponding PCT application No. PCT/IB2015/054074.

* cited by examiner

REINFORCEMENT RING FOR CAPSULES FOR OBTAINING BEVERAGES

TECHNOLOGICAL FIELD

The present invention concerns the field of capsules for obtaining beverages, for example espresso coffee or the like. More specifically, the present invention concerns the field of reinforcement rings for capsules for obtaining beverages.

BACKGROUND ART

On the market there is a vast range of reinforcement rings for capsules for obtaining beverages. Examples of such rings can be found in the European Patent Application published with number EP 2 555 997A1.

Known devices, however, have some drawbacks.

They are often heavy and bulky and this characteristic makes them, for example, not very suitable for satisfying the requirements necessary to be classified as biodegradable and/or compostable and/or biobased (i.e. from renewable sources). Moreover, the large amount of material required to make such rings makes them expensive.

Known devices also comprise special elements that make their production complex, expensive and slow. Known rings also excessively wear out the machines used to produce them, handle them or use them.

The purpose of the present invention is, therefore, to provide reinforcement rings for capsules for obtaining beverages that allow the problems of known systems of the state of the art to be overcome.

SUMMARY

The present invention is based on the idea of making a reinforcement ring with reduced thickness areas, so as to decrease the total amount of material used to produce it, whilst still ensuring the stability of the ring.

According to an embodiment of the present invention, a reinforcement ring for capsules for obtaining infusion beverages, for example espresso, coffee, tea or the like, is provided, comprising a side wall and a flat surface, preferably having a uniform thickness protruding from the side wall, in which the side wall and the flat surface having a uniform thickness are preferably made in a single body and in which the side wall comprises reduced thickness areas, so as to reduce the total amount of material used for the production of the reinforcement ring. In this way the costs and production time of the ring are reduced. Moreover, given that the reduced thickness areas are provided on the side wall of the ring, the asymmetry in the distribution of the masses of the system is increased with respect to rings known in the state of the art, in this way facilitating the orientation of the rings in the possible sorting or handling steps necessary when capsules comprising reinforcement rings are made. In particular, the portion of the side wall comprising the reduced thickness areas has a much smaller mass than the portion of the ring comprising the flat surface protruding from the side wall. The presence of the reduced thickness areas also facilitates the compostability of the system if it is made from biodegradable or compostable materials. Moreover, the structure of the ring based on the present invention makes it possible to avoid or in any case minimise the crystallisation of the biodegradable and/or compostable materials, if present.

According to a further embodiment of the present invention, a reinforcement ring for capsules for obtaining beverages is provided in which the reduced thickness areas have a non-uniform thickness, preferably having a thickness that reduces as the distance from the protruding flat surface increases. This allows the asymmetry in the distribution of the masses of the system to be further increased.

According to a further embodiment of the present invention, a reinforcement ring for capsules for obtaining beverages is provided in which the reduced thickness areas are shaped like a U or V, preferably inverted with respect to the protruding flat surface. The reinforcement ring according to this embodiment is particularly manoeuvrable and therefore easy to use. The flaring of the U shapes or of the V shapes, inverted with respect to the protruding flat surface, allows the asymmetry in the distribution of the masses of the system to be further increased. In particular, the masses of the system as further concentrated towards the protruding flat surface whereas large regions of the side wall facing in the opposite direction with respect to the protruding flat surface have reduced thickness and therefore reduced mass.

According to a further embodiment of the present invention, a reinforcement ring for capsules for obtaining beverages is provided in which the reduced thickness areas are arranged periodically along the entire length or the circumference of the side wall. In this way, the elasticity and the stability of the ring are optimized. The periodic arrangement of the reduced thickness areas also facilitates the maneuverability of the ring. It can indeed be easily gripped through suitable tools, for example when it is extracted from the mold in which it is formed or when it is handled in the production steps of capsules comprising reinforcement rings.

According to a further embodiment of the present invention, a reinforcement ring for capsules for obtaining beverages is provided in which the reduced thickness areas are made on the outer surface of the side wall. This allows the ring to be more maneuverable.

According to a further embodiment of the present invention, a reinforcement ring for capsules for obtaining beverages is provided in which the thickness of the reduced thickness areas is preferably comprised between 8% and 80% of the thickness of the side wall. For example, the thickness of the reduced thickness areas can be comprised between 0.1 mm and 1 mm. This allows the total amount of material used to produce the ring to be reduced and at the same time allows its properties of stability and reliability to be maintained.

According to a further embodiment of the present invention, a reinforcement ring for capsules for obtaining beverages is provided in which the side wall comprises grooves. In this way, the total amount of material used to produce the reinforcement ring is further reduced, whilst still maintaining its stability.

According to a further embodiment of the present invention, a reinforcement ring for capsules for obtaining beverages is provided such that the grooves are cut on the inner surface of the side wall. The reinforcement rings thus made wear out the machines with which they are produced less. Indeed, the reinforcement rings made with circular threadings that protrude on the inner surface of the side wall towards the inside of the reinforcement ring, as well as requiring the use of a greater amount of material, cause greater wearing, due to rubbing, of the components of the machines with which they are produced or maneuvered or used.

According to a further embodiment of the present invention, a reinforcement ring for capsules for obtaining beverages is provided in which the grooves have an extension or width, along the surface of the side wall, comprised between 0.1 mm and 1 mm, preferably equal to 0.5 mm.

According to a further embodiment of the present invention a reinforcement ring is provided in which the side wall comprises a protruding edge, preferably made on the inner surface of the side wall. The body of the capsule can be advantageously fixed to the protruding edge. In this way, it is ensured that there is stable adherence between the reinforcement ring and the capsule to which it is mounted.

According to a further embodiment of the present invention, a reinforcement ring for capsules for obtaining beverages is provided in which the region where the side wall and the protruding flat surface meet comprises an empty channel. In this way, it is possible to further reduce the total amount of material used to produce the ring, whilst still maintaining its stability and reliability.

According to a further embodiment of the present invention, a reinforcement ring for capsules for obtaining beverages is provided in which the side wall comprises a flaring or a spoking oriented towards the inside of the ring so as to comprise at least a frusto-conical portion. The portion of the side wall comprising the flaring or spoking can be preferably the lower portion of the side wall, opposite with respect to the portion from which the protruding flat surface of the ring protrudes. The flaring or spoking makes the ring particularly easy to maneuver. Moreover, the tolerances and the possibilities of insertion of the ring in different apparatuses, for example drums, used for the production of capsules comprising reinforcement rings are increased.

According to a further embodiment of the present invention, a reinforcement ring for capsules for obtaining beverages is provided comprising biodegradable, compostable and/or biobased material, for example PLA, PHA, PBS, Starch Blensd, biobased PE, PET, PA, PTT. The advantages of making the ring from biodegradable, compostable and/or biobased material are those that are known and connected to environmental protection.

According to a further embodiment of the present invention, a reinforcement ring for capsules for obtaining beverages is provided in which the amount of biodegradable, compostable and/or biobased material is comprised between 1% and 100%, preferably between 20% and 80%, of the total amount of material of the ring.

According to a further embodiment of the present invention, a capsule for obtaining beverages, for example espresso coffee, is provided, comprising a reinforcement ring according to the present invention and a capsule body suitable for forming a containment volume for the product used to obtain the desired beverage, for example ground or powdered coffee, tea, powdered milk, cocoa or the like.

According to a further embodiment of the present invention, a capsule is provided in which the capsule body is made from permeable, filtering and thermoformable material, for example SMASH™.

According to a further embodiment of the present invention, a capsule is provided in which the capsule body is made from biodegradable, compostable and/or biobased material, for example PLA, PHA, PBS, Starch Blensd, biobased PE, PET, PA, PTT.

BRIEF DESCRIPTION OF THE FIGURES

The present invention will be described with reference to the attached figures in which the same reference numbers and/or markings indicate the same and/or the like and/or corresponding parts of the system.

DETAILED DESCRIPTION

Hereafter, the present invention is described with reference to particular embodiments, as illustrated in the attached tables of drawings. However, the present invention is not limited to the particular embodiments described in the following detailed description and represented in the figures, but rather the described embodiments simply exemplify the various aspects of the present invention, the purpose of which is defined by the claims. Further modifications and variations of the present invention will be clear to those skilled in the art.

Figure 1:
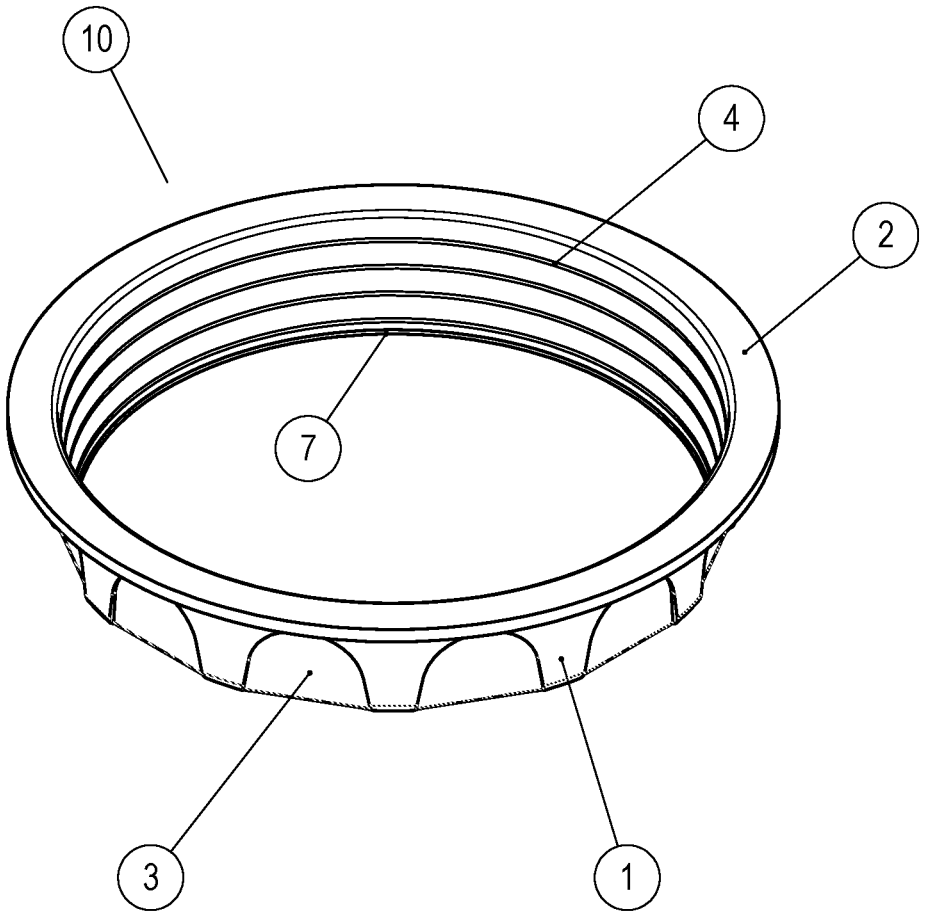
FIG. 1 schematically illustrates a 3D view of a reinforcement ring for capsules for obtaining beverages, according to an embodiment of the present invention.

FIG. 1 schematically illustrates a 3D view of a reinforcement ring 10 for capsules for obtaining beverages according to an embodiment of the present invention.

The ring 10 comprises a side wall 1 and a flat surface 2 protruding from the side wall 1. The flat surface 2 of the system shown in the Figures has a uniform thickness, i.e. constant along its entire length.

The center of the smallest circumference of the reinforcement ring 10 defined by the protruding flat surface 2 is defined as the center. The center of the ring is in the inner region of the reinforcement ring 10.

The protruding flat surface 2 protrudes from the side wall 1 towards the outside of the reinforcement ring 10. The side wall 1 and the flat surface having uniform thickness 2 meet so as to form an angle of 90° or more.

The side wall 1 and the protruding flat surface 2 are preferably made as a single body, for example, using a hot and/or injection moulding process or a compress& and thermoforming process.

The side wall 1 comprises reduced thickness areas 3 on its outer surface, i.e. on the surface facing towards the outside of the reinforcement ring 10. The side wall 1 of the system shown in the figures also comprises grooves 4 and a protruding edge 7 on its inner surface, i.e. on the surface facing towards the inside of the reinforcement ring 10.

The reduced thickness areas 3 are shaped like a U that is inverted with respect to the protruding flat surface 2. According to alternative embodiments of the present invention, the reduced thickness areas 3 can be shaped like a V that is inverted with respect to the protruding flat surface or semi-circular, linear rectangular, square or polygonal shaped, for example so as to form a semi-hexagon or a semi-octagon. There can also be additional shapes.

The reduced thickness areas 3 of the system shown in the figures are arranged periodically along the entire length of the outer surface of the side wall 1. In particular, the reduced thickness areas 3 are arranged beside one another so as not to overlap so as to leave areas with non-reduced thickness arranged between the reduced thickness areas.

The number of reduced thickness areas 3 can be comprised between 359 and 2 and can preferably be equal to 12.

The reduced thickness areas 3 can be made so as to have uniform thickness or, as shown in the figures, so that the thickness of the reduced thickness areas 3 decreases going away from the region in which the protruding flat surface 2 is arranged.

The thickness of the reduced thickness areas 3 can be comprised between 0.1 mm and 1 mm, preferably between 8% and 80% of the maximum thickness of the side wall 1.

There are multiple advantages of making a reinforcement ring 10 with reduced thickness areas 3. Firstly, by decreasing the thickness of the side wall 1 in some areas, the total amount of material used to produce the reinforcement ring 10 decreases. This makes it possible both to reduce costs, and to increase the production speed of the rings. The moulding time can, indeed, decreases even by 20%-40%. Moreover, the presence of the reduced thickness areas 3 and their particular shape, for example like a U or V, give the ring better elastic properties, so as to facilitate, for example, its insertion in the drum during the production step of capsules comprising such rings. Moreover, the U or V shape of the reduced thickness areas 3 increases the asymmetry of the reinforcement ring 10. More specifically, the U or V shape of the reduced thickness areas ensures that the reinforcement ring 10 weighs less in the region opposite the protruding flat surface 2. This facilitates the sorting operation of the reinforcement rings. Indeed, the reinforcement rings, thanks to their structural asymmetry, if left free to fall, automatically orientate themselves so that the heaviest part, therefore that of the flat surface having uniform thickness 2, faces towards the direction of fall. Moreover, the particular U or V shape and the periodic arrangement of the reduced thickness areas makes it possible to obtain all of the advantages just listed, while at the same time maintaining the reliability and stability of the reinforcement ring 10, thus avoiding its fragility increasing too much. Finally, in the case in which the ring comprises biodegradable, compostable and/or biobased material, the arrangement of the reduced thickness areas 3 along the side wall 1 minimises the crystallisation effect of the biodegradable, compostable and/or biobased material comprised in the ring.

The grooves 4 of the side wall 1 are cut inside the inner surface of the side wall 1. The grooves 4 can have a width, along the surface of the side wall 1, comprised between 0.1 mm and 1 mm, preferably equal to 0.5 mm. They can be in a number comprised between 2 and 6, preferably 4.

There are multiple advantages of making a reinforcement ring 10 comprising grooves 4 on the inner surface of the side wall 1. Firstly, by further decreasing the thickness of the inner surface of the side wall 1 in some areas, the total amount of material used to produce the reinforcement ring 10 decreases. This makes it possible both to reduce costs, and to increase the production speed of the rings. Moreover, by making grooves 4, the wearing of the machines using the reinforcement rings to produce capsules comprising such rings is reduced. For example, the extraction of the rings from the press in which they are formed is made easier and the friction is reduced during the steps of insertion and extraction from the drum with which the capsules comprising reinforcement rings are produced.

Figure 3:
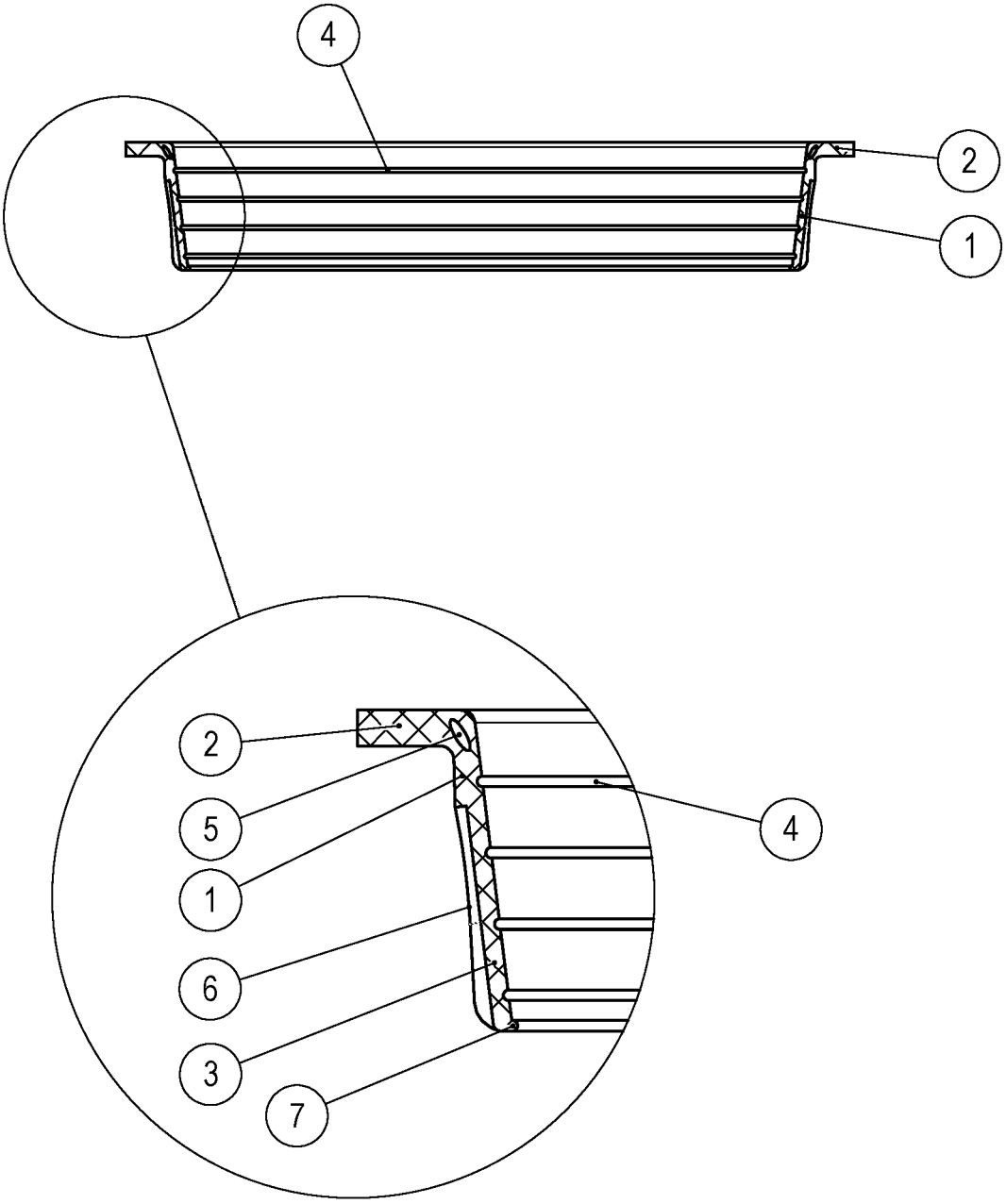
FIG. 3 schematically illustrates a cut-away view of the reinforcement ring for capsules for obtaining beverages shown in FIG. 1. A detail of the reinforcement ring is shown enlarged (panel in the bottom left).
Figure 6:
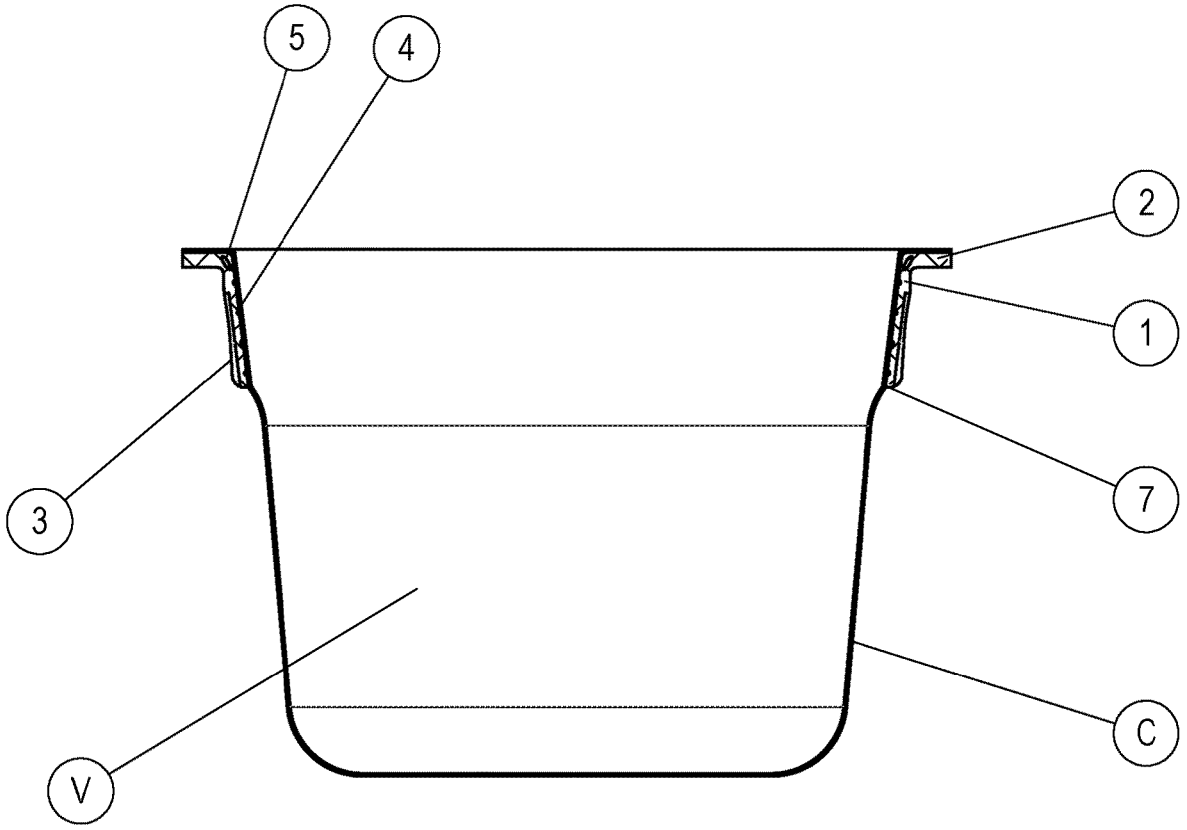
FIG. 6 schematically illustrates a capsule for obtaining beverages comprising a reinforcement ring, according to an embodiment of the present invention.

The protruding edge 7, as can be seen more clearly in FIGS. 3 and 6, comprises a edge protruding towards the inside of the reinforcement ring 10 from the end of the side wall 1 opposite with respect to the end from which the protruding flat surface 2 protrudes. In the embodiments shown, the protruding edge 7 comprises a continuous edge along the entire circumference of the inner surface of the side wall 1, but the protruding edge 7 can also comprise a discontinuous edge. The protruding edge 7, as specified more clearly with reference to FIG. 6, facilitates a secure and stable adhesion of the reinforcement ring 10 to the capsule for obtaining beverages, to which it is applied.

Figure 2:
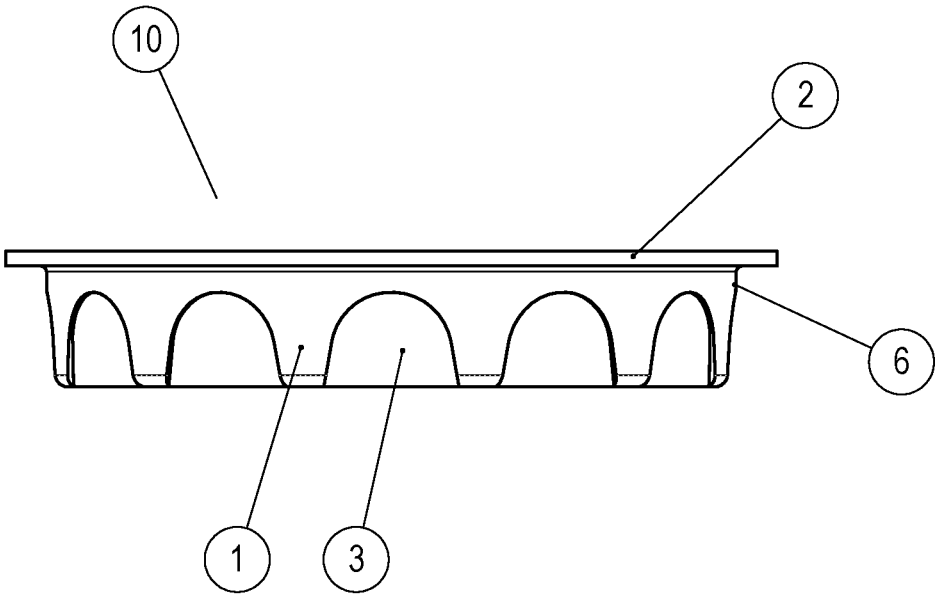
FIG. 2 schematically illustrates a side view of the reinforcement ring for capsules for obtaining beverages shown in FIG. 1.

FIG. 2 schematically illustrates a side view of the reinforcement ring for capsules for obtaining beverages shown in FIG. 1.

In the figure the reduced thickness areas 3 are clearly visible on the outer surface of the side wall 1 of the reinforcement ring 10. The protruding flat surface 2 has a uniform thickness and protrudes towards the outside of the reinforcement ring 10, with respect to the side wall 1. The protruding flat surface 2 can be advantageously used as flat support surface for sealing elements, for example membranes, used to hermetically seal the capsules provided with reinforcement rings according to the present invention.

FIG. 2 also shows that the side wall 1 comprises a frusto-conical portion 6. In particular, the side wall 1 is countersunk in the direction facing towards the inside of the ring. The frusto-conical portion 6 is the lower portion of the side wall 1 shown in the Figures, i.e. the portion of the side wall 1 opposite with respect to the portion from which the protruding flat surface 2 protrudes.

FIG. 3 schematically illustrates a cut-away view of the reinforcement ring for capsules for obtaining beverages shown in FIG. 1. A detail of the reinforcement ring is shown enlarged (panel in the bottom left).

In the figure, the grooves 4 made on the inner surface of the side wall 1 and the protruding edge 7 are clearly visible.

An empty channel 5 in the region in which the side wall 1 meets the protruding flat surface 2 is also visible. Making this empty channel 5 makes it possible to decrease the total amount of material necessary to make the reinforcement ring 10, thus reducing the production time and costs thereof, but still maintaining the properties of stability and reliability of the ring.

Figure 4:
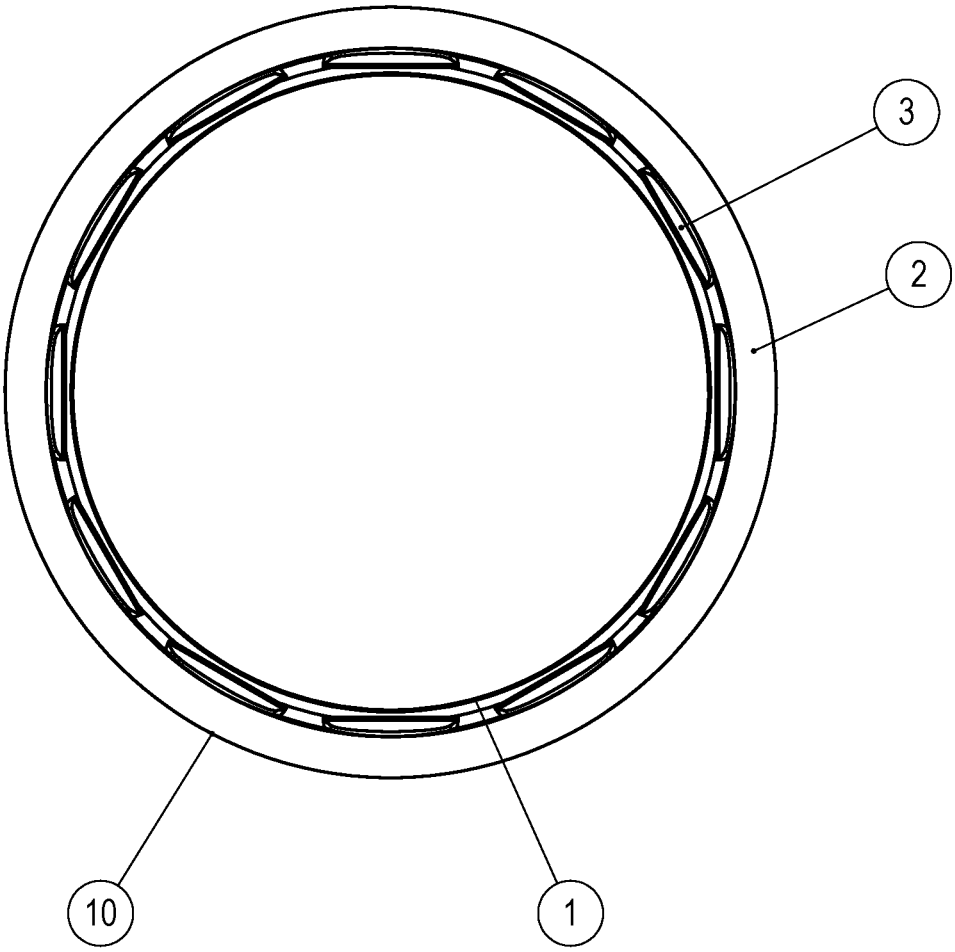
FIG. 4 schematically illustrates a view from below of the reinforcement ring for capsules for obtaining beverages shown in FIG. 1.

The panel in the bottom left shows an enlarged detail of the reinforcement ring 10 shown in FIG. 4. The grooves 4, the protruding flat surface 2, the side wall 1 and the protruding edge 7 are clearly visible. The outer surface of the side wall 1 comprises reduced thickness areas 3. One of these is visible in section. It should be noted that the side wall 1 comprises the frusto-conical portion 6. It should also be noted that the thickness of the reduced thickness area 3 reduces as the distance from the protruding flat surface 2 increases.

FIG. 4 schematically illustrates a view from below of the reinforcement ring for capsules for obtaining beverages shown in FIG. 1, i.e. seen from the end of the side wall opposite with respect to the end from which the protruding flat surface 2 protrudes. It is possible to see the protruding flat surface 2 and the outer surface of the side wall 1 comprising the reduced thickness areas 3.

Figure 5:
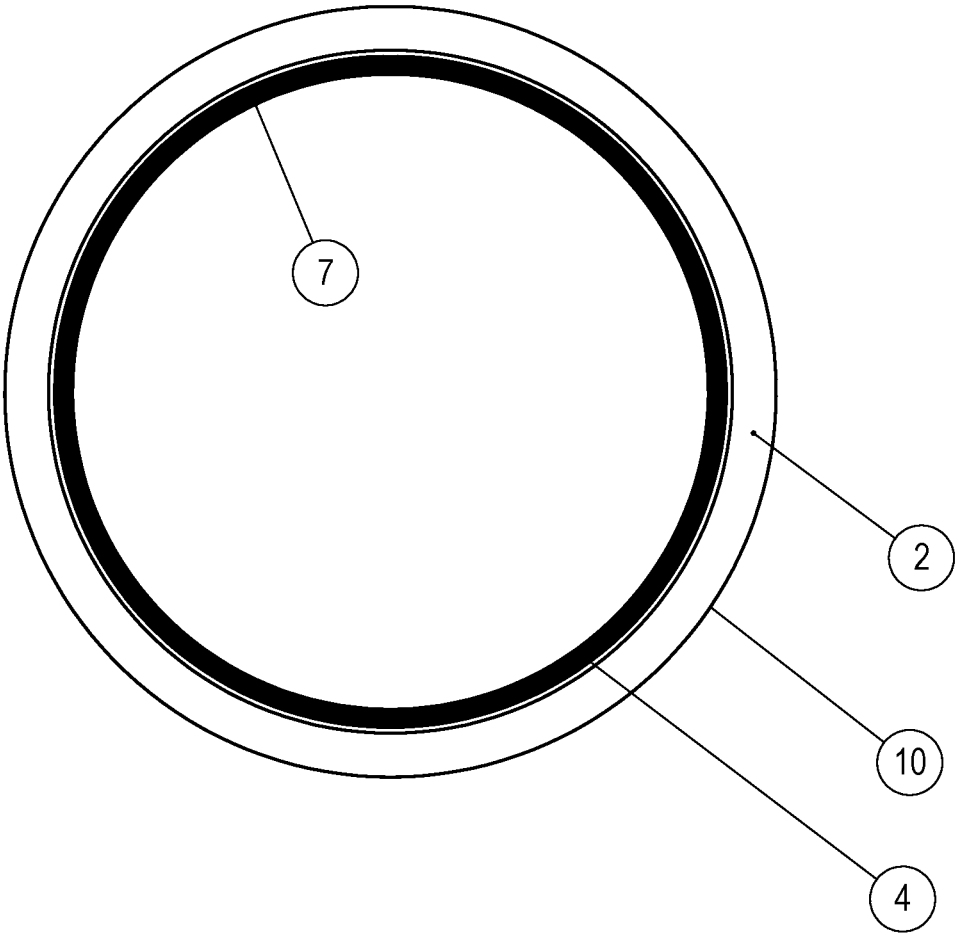
FIG. 5 schematically illustrates a view from above of the reinforcement ring for capsules for obtaining beverages shown in FIG. 1.

FIG. 5 schematically illustrates a view from above of the reinforcement ring for capsules for obtaining beverages shown in FIG. 1, i.e. seen from the end of the side wall from which the protruding flat surface 2 protrudes.

It is possible to see the flat surface having uniform thickness 2 and the inner surface of the side wall 1 comprising the grooves 4.

Hereafter, some size values of reinforcement rings according to the present invention will be provided as an example.

As shown in the attached Figures, the side wall 1 preferably comprises a frusto-conical shaped portion 6.

According to embodiments of the present invention, the diameter of the narrowest part of the frustum of cone has a value comprised between 41.0 mm and 43.0 mm, preferably equal to 42.0 mm.

The diameter of the widest part of the frustum of cone, from which the surface 2 protrudes, can have a value comprised between 44.0 mm and 45.0 mm, preferably equal to 44.5 mm.

The thickness of the side wall 1 can be comprised between 0.1 mm and 1 mm, preferably equal to 0.5 mm.

The protruding flat surface 2 can have an internal diameter comprises between 44.0 mm and 45.0 mm, preferably equal to 44.5 mm and an external diameter comprised between 50.0 mm and 52.0 mm, preferably equal to 51 mm.

The specified values relative to the possible dimensions of a reinforcement ring 10 according to the present invention are only indicative. Indeed, it is possible to make reinforcement rings of any size, adaptable, therefore, to capsules of different sizes.

A reinforcement ring 10 according to the present invention can have a mass comprised between 1 gr. and 2 gr., preferably equal to 1.7 gr. It is useful to note that a reinforcement ring of similar dimensions (diameters) based on the state of the art has a mass of 2.5 gr. and this shows the saving of material that can be obtained according to the present invention.

It is thus clear that a reinforcement ring 10 according to the present invention, having, in different parts, a smaller thickness with respect to a reinforcement ring known in the state of the art, more easily satisfies the criteria necessary to be classified as biodegradable and/or compostable and/or biobased. Indeed, it is clear that regions of reduced thickness are broken down and/or composted more easily and quickly than surfaces made from the same material, but having uniform or greater thickness.

The reinforcement rings according to the present invention can indeed be made from biodegradable, compostable and/or biobased material, for example PLA, PHA, PBS, Starch Blensd, biobased PE, PET, PA, PTT. The amount of biodegradable and/or compostable material can be comprised between 1% % and 100%, preferably between 20% and 80% of the total amount of material used for the production of the reinforcement ring 10.

FIG. 6 schematically illustrates a capsule for obtaining beverages comprising a reinforcement ring according to an embodiment of the present invention. The capsule to which the reinforcement ring 10 is applied generally comprises a capsule body C, suitable for forming a containment volume V for the substance used to obtain the desired beverage, for example ground or powdered coffee, tea leaves, chocolate, powdered milk and so on.

The capsule body C can be preferably made from permeable, filtering and thermoformable material, for example SMASH™. Moreover, the capsule body can be made from biodegradable, compostable and/or biobased material, for example PLA, PHA, PBS, Starch Blensd, biobased PE, PET, PA, PT.

The capsule body can be fixed to the inner surface of the side wall 1 of the reinforcement ring 10. Moreover, if the ring comprises the protruding edge 7, the capsule body C can be fixed to it ensuring the adhesion between the reinforcement ring 10 and the capsule body C even in the case in which the side wall 1 of the reinforcement ring 10 does not completely adhere to it. The reinforcement ring reinforces the structure of the capsule, making it stable and easy to maneuver.

Even though the present invention has been described with reference to the embodiments described above, it is clear to those skilled in the art that it is possible to make different modifications of the present invention in light of the teaching described above and in the attached claims, without departing from the scope of protection of the invention.

For example, the dimensions of the ring can suitably vary, so as to be able to apply the ring to different capsules to obtain beverages, for example with single-dose capsules containing different amounts of product from which to obtain the desired beverage. Moreover, the shape, arrangement, the number and the dimensions of the reduced thickness areas and of the grooves can suitably vary. For example, the reduced thickness areas could have a profile that is circular, square, rectangular, a combination thereof or the like. Moreover, even though in the attached figures circular shaped rings have been shown, the present invention is not limited to such shapes. Indeed, it is possible to make polygonal rings, i.e. having a side wall that, in horizontal section, has a polygonal shape, for example triangular, square, rectangular, pentagonal, hexagonal, octagonal, dodecagonal. The protruding flat surface can also have different shapes.

Finally, those aspects that are considered known by those skilled in the art have not been described in order to avoid needlessly excessively obscuring the description of the invention.

Consequently, the invention is not limited to the embodiments described above, but is only limited by the scope of protection of the attached claims.

What is claimed is:

1. A capsule for making infusion beverages, the capsule which comprises:

a permeable material capsule body suitable to form a containment volume for a product used to make the infusion beverage; and a reinforcement ring reinforcing the permeable material capsule body, the reinforcement ring comprising:

a side wall having a circumference configured to fit within a device for obtaining infusion beverages, said side wall having an outer wall surface and an inner wall surface;

a flat surface configured to be held in the device for obtaining infusion beverages, wherein the flat surface protrudes from said side wall, said side wall and said flat surface forming an integral single body, wherein formed in said side wall are side wall depressions spaced in a circumferential direction along the circumference with separating side wall portions separating the side wall depressions, wherein reduced thickness areas of said side wall provided by said side wall depressions have a radial thickness that decreases going away from the flat surface, and wherein the inner wall surface is fixed to the permeable material capsule body.

2. The capsule according to claim 1, wherein said side wall depressions are configured to provide thickness areas having a non-uniform thickness.

3. The capsule according to claim 1 wherein said side wall depressions comprise U-shape depressions.

4. The capsule according to claim 1 wherein said side wall depressions are periodically spaced in the circumferential direction along a whole length of the circumference of said side wall.

5. The capsule according to claim 1 wherein said side wall depressions are placed on an outer surface of said side wall.

6. The capsule according to claim 1 wherein a thickness of reduced thickness areas of said side wall depressions is comprised between 8% and 80% of a maximum thickness of said side wall.

7. The capsule according to claim 1 wherein said side wall depressions comprise parallel grooves forming closed rings in separated non-intersecting planes realized on the inner wall surface of said side wall.

8. The capsule according to claim 7, wherein said grooves have a width comprised between 0.1 mm and 1 mm.

9. The capsule according to claim 1 wherein said side wall comprises a protruding edge realized on the inner wall surface of said side wall.

10. The capsule according to claim 1 wherein where said side wall and said flat surface meet there is an empty channel.

11. The capsule according to claim 1 wherein said side wall is oriented toward an inner side of the permeable capsule reinforcement ring so as to comprise at least a frusto-conical portion.

12. The capsule according to claim 1 which comprises a biodegradable, a compostable and/or a biobased material.

13. The capsule according to claim 12, wherein an amount of the biodegradable and/or compostable and/or biobased material is comprised between 1% and 100% of a total amount of material in the reinforcement ring.

14. The capsule according to claim 13, wherein an amount of the biodegradable and/or compostable and/or biobased material is comprised between 20% and 80% of the total amount of material in said reinforcement ring.

15. The capsule according to claim 1, wherein said capsule body is made of a permeable, filtering and thermoformable material.

16. The capsule according to claim 1 wherein said capsule body is made of biodegradable and/or compostable material.

17. The capsule according to claim 1 wherein said side wall depressions have a V-shape.

18. The capsule according to claim 1, wherein:

a total combined circumferential length of said side wall depressions is greater than a total combined circumferential length of said separating side wall portions.

19. A beverage capsule reinforcement ring reinforcing a liquid permeable material capsule body of a beverage capsule, the reinforcement ring comprising:

a side wall having a circumference configured to fit within a device for obtaining beverages and an outer wall surface and an inner wall surface, said sidewall having a first side wall material radial thickness extending from the outer wall surface to the inner wall surface;

reduced thickness areas formed periodically around the circumference along a circumferential direction in said side wall indented inwardly from the outer wall surface, said reduced thickness areas having a second side wall material radial thickness extending from the reduced thickness areas to the inner wall surface, wherein the second side wall material radial thickness is less than the first side wall material radial thickness;

a flat surface extending radially from an edge of said side wall configured to be held in the device for obtaining beverages;

wherein said reduced thickness areas formed in said side wall have a radial thickness that decreases going away from said flat surface; and ring grooves formed in the inner wall surface, wherein the inner wall surface is fixed to the liquid permeable material capsule body.

20. A permeable beverage capsule used in making infusion beverages, the permeable beverage capsule comprising:

a liquid permeable material forming a capsule body configured to fit within a device for obtaining infusion beverages;

a reinforcement ring encircling and attached to an edge portion of said liquid permeable material forming a capsule body, said reinforcement ring configured to be held in the device for obtaining infusion beverages, said reinforcement ring comprising:

a flat surface forming a ring having an inner edge;

a cylindrical side wall extending from the inner edge of said flat surface and having an outer and inner wall surface, said cylindrical side wall having a first side wall material radial thickness; and reduced thickness areas indented inwardly from the outer wall surface and having a second side wall material radial thickness formed in the outer wall surface periodically around a circumference along a circumferential direction of said cylindrical side wall, wherein the second side wall material radial thickness is less than the first side wall material radial thickness.

21. The permeable beverage capsule used in making infusion beverages as in claim 20 wherein:

said reduced thickness areas have a decreasing material radial thickness in a direction extending from said flat surface.

22. The permeable beverage capsule used in making beverages as in claim 20 further comprising:

a closed ring groove formed in the inner wall surface of said cylindrical side wall of said reinforcement ring.

23. A permeable beverage capsule used in making infusion beverages, the permeable beverage capsule comprising:

a liquid permeable material forming a capsule body configured to fit within a device for obtaining infusion beverages;

a reinforcement ring encircling and attached to an edge portion of said liquid permeable material forming a capsule body, said reinforcement ring configured to be held in the device for obtaining infusion beverages, said reinforcement ring comprising:

a flat surface forming a ring having an inner edge;

a side wall ring extending from the inner edge of said flat surface and having an outer side wall surface and an inner side wall surface, said side wall ring having a first side wall material radial thickness; and reduced thickness areas indented inwardly from a surface of said side wall ring, said reduced thickness areas formed in the surface periodically around a circumference of said side wall ring along a circumferential direction, each of said reduced thickness areas having a second side wall material radial thickness, wherein the second side wall material radial thickness is less than the first side wall material radial thickness.

* * * * *